United States Patent [19]

Cohen et al.

[11] Patent Number: 4,875,432

[45] Date of Patent: Oct. 24, 1989

[54] VOLLEYBALL SCOREBOARD

[76] Inventors: Joseph D. Cohen, P.O. Box 292401, Lewisville, Tex. 75029-2401; Hyman H. Cohen, 120 DeMont Ave. East No. 309, Little Canada, Minn. 55117

[21] Appl. No.: 258,798

[22] Filed: Oct. 17, 1988

[51] Int. Cl.[4] ..... A63B 71/06

[52] U.S. Cl. ..... 116/223; 116/309; 116/311

[58] Field of Search ..... 116/223, 222, 309, 313, 116/312; 273/29 A, 29 B, 29 R, DIG. 26, 411, 184 R, 374, 387; 340/323 R; 46/311, 315, 316, 319, 318, 320, 334, 335; 235/90

[56] References Cited

U.S. PATENT DOCUMENTS

| | | | |
|---|---|---|---|
| 1,967,217 | 7/1934 | Amsden | 116/223 |
| 2,166,335 | 7/1939 | Banner | 116/223 |
| 3,226,022 | 12/1965 | Walthers | 116/223 |
| 3,803,831 | 4/1974 | Horzick | 116/335 |
| 3,853,090 | 12/1974 | Watson et al. | 116/312 |
| 3,860,240 | 11/1975 | Koch | 273/29 B |
| 4,372,561 | 2/1983 | Morgan et al. | 273/411 |

FOREIGN PATENT DOCUMENTS

| | | | |
|---|---|---|---|
| 0031033 | 11/1980 | European Pat. Off. | 273/DIG. 26 |
| 542074 | 12/1939 | United Kingdom | 116/223 |
| 538655 | 2/1940 | United Kingdom | 116/223 |

*Primary Examiner*—William A. Cuchlinski, Jr.
*Assistant Examiner*—Tunley J. Hohenshell
*Attorney, Agent, or Firm*—Hubbard, Thurman, Turner & Turner

[57] ABSTRACT

Translucent and opaque graphics are mounted on transparent sheets and laminated to form a net ball game scoring device designed specifically for but not limited to the game of volleyball. The device is designed to be mounted to the net for quick reference and access by the players. Score indicators have a common axis and are color coded to differentiate the team's scores. Utilizing translucent graphics, the score indicators change color when the score is tied. The dynamic score indicators are contained internally in the transparent laminate so they cannot be accidentally changed. The two dynamic score indicators' positions are changed by dialing them through one of two slots located on opposite faces of the device so as each team has access only to its own score indicator.

15 Claims, 4 Drawing Sheets

VOLLEYBALL SCOREBOARD

BACKGROUND OF THE INVENTION (a) Field of the Invention

The present invention relates generally to game score indicators and more particularly to a volleyball scoreboard.

(b) Description of the Prior Art

Although one is badly needed, a practical and cost efficient scorekeeping device for the game of volleyball has never been invented. The manual units that do exist are designed to be operated by someone not in the game, mostly because they are installed well outside the court. For a player to reference the score he must focus his attention outside the game area which is a distraction to playing the game. Another disadvantage is these existing score apparatus are big and cumbersome and are not easily transported. Also, the score can accidentally be changed on these units if they are hit by the ball. Competition volleyball is normally scored by an expensive, permanently installed electronic scoreboard. Consequently, in practice scrimmages and recreational volleyball the accepted scorekeeping procedure is for the current server to call both teams' scores before each serve. This method always creates some degree of confusion and arguments, which break the players' concentration and take enjoyment out of the game.

SUMMARY OF THE INVENTION

It is an object of the present invention to provide a practical cost-efficient lightweight and durable player operated volleyball game scoring device that mounts to the game net for easy reference and access.

It is also an object of the present invention to provide a game scoring device that is quickly referenced at a glance by players of either team by utilizing two score indicators with commom axis, start points, and end points housed in a transparent laminate. Additionally, the indicators are color coded to differentiate the teams' scores and are translucent so as to change color in the event of a tie score.

It is also an object of the present invention to provide a game scoring device that will not change score when hit with the ball by encasing the dynamic score indicators in a laminated transparent housing.

It is also an object of the present invention to provide a game scoring device that will allow a team visual reference of both score indicators via a transparent housing, but manipulatory access to only their own score indicator via an access slot located on the face of the device.

DESCRIPTION OF THE PREFERRED EMBODIMENT

Figure 3B:
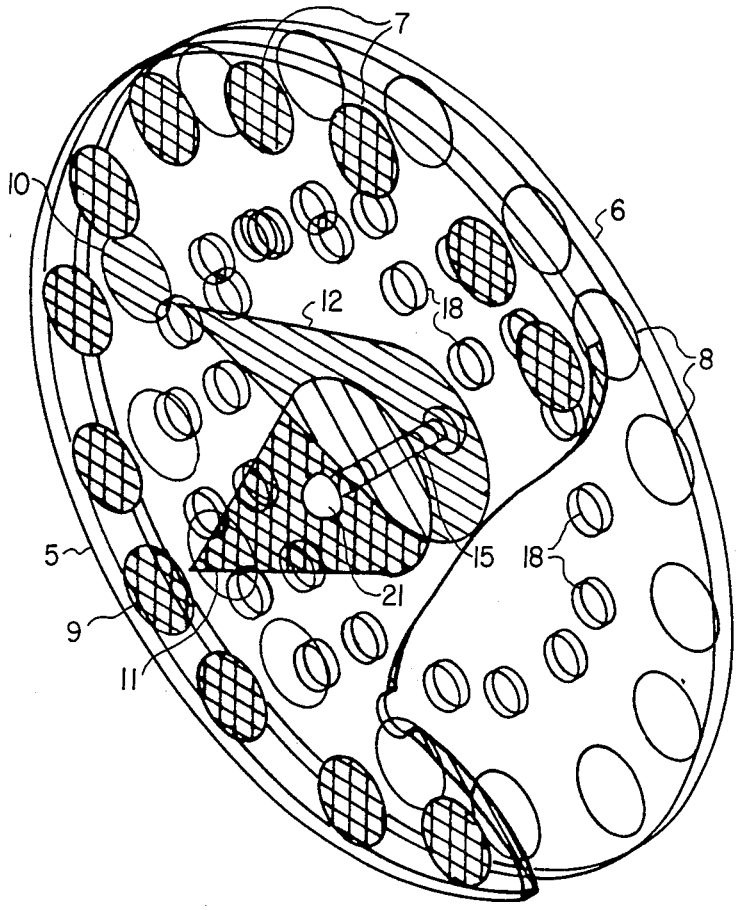
FIG. 3B is a perspective view of the score indicator discs of the volleyball scoreboard of the present invention.
Figure 3A:
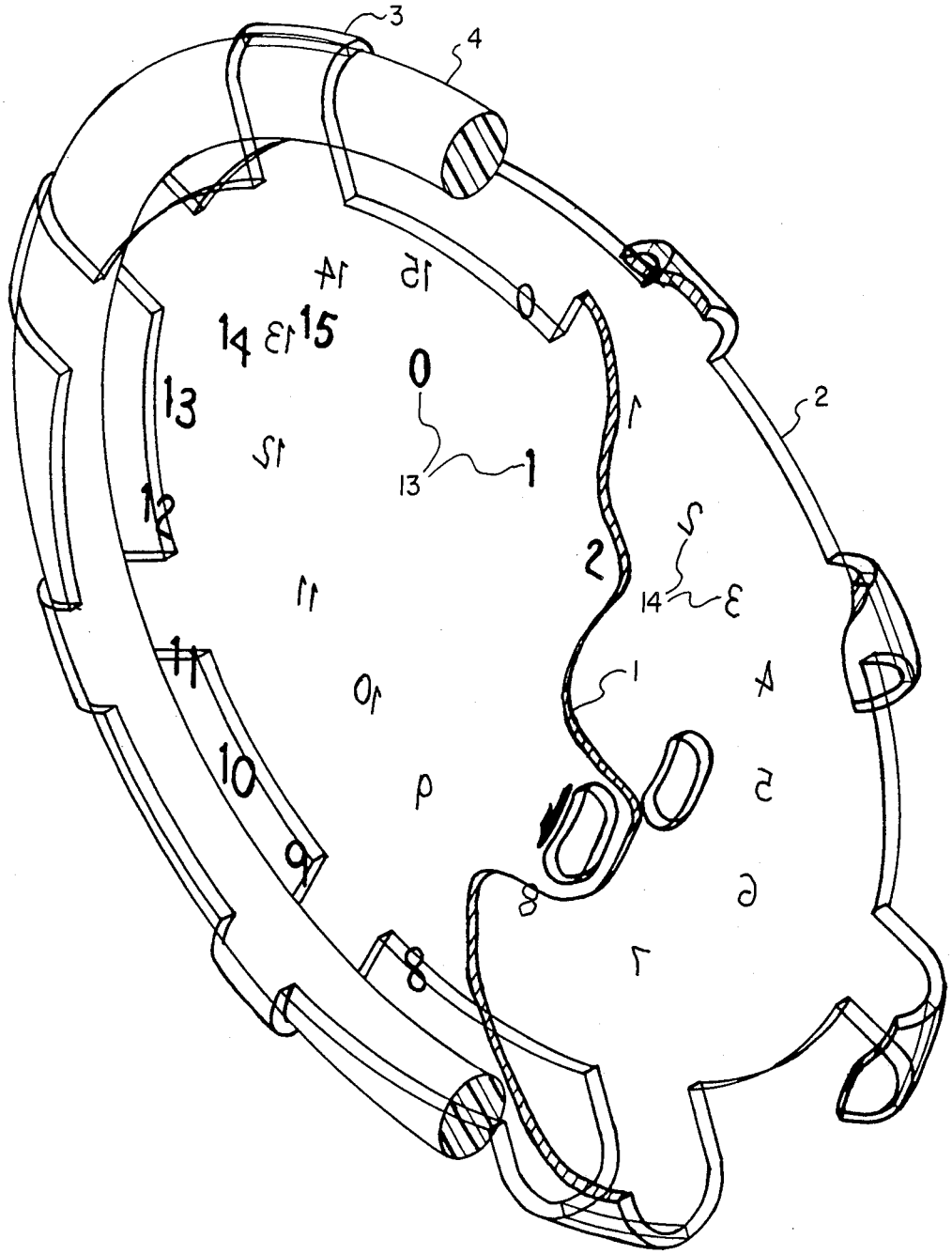
FIG. 3 is a perspective view of the housing of the vollyball scoreboard of the present invention.

Referring to FIGS. 3A and 3B, the scoreboard of the present invention includes two transparent housing halves 1 and 2 that are adjoined around frame hoop 4 at housing weld joints 3 with an adhesive. The scoreboard also includes two transparent score indicator disks 5 and 6. The two score indicator disks 5 and 6 are rotatably mounted on disk axle 21 within the composite transparent housing 1 and 2. Thus, the score indicator disks' positions will be protected by the housing and will not be accidentally changed by external forces such as a volleyball player's missed shot.

Figure 1A:
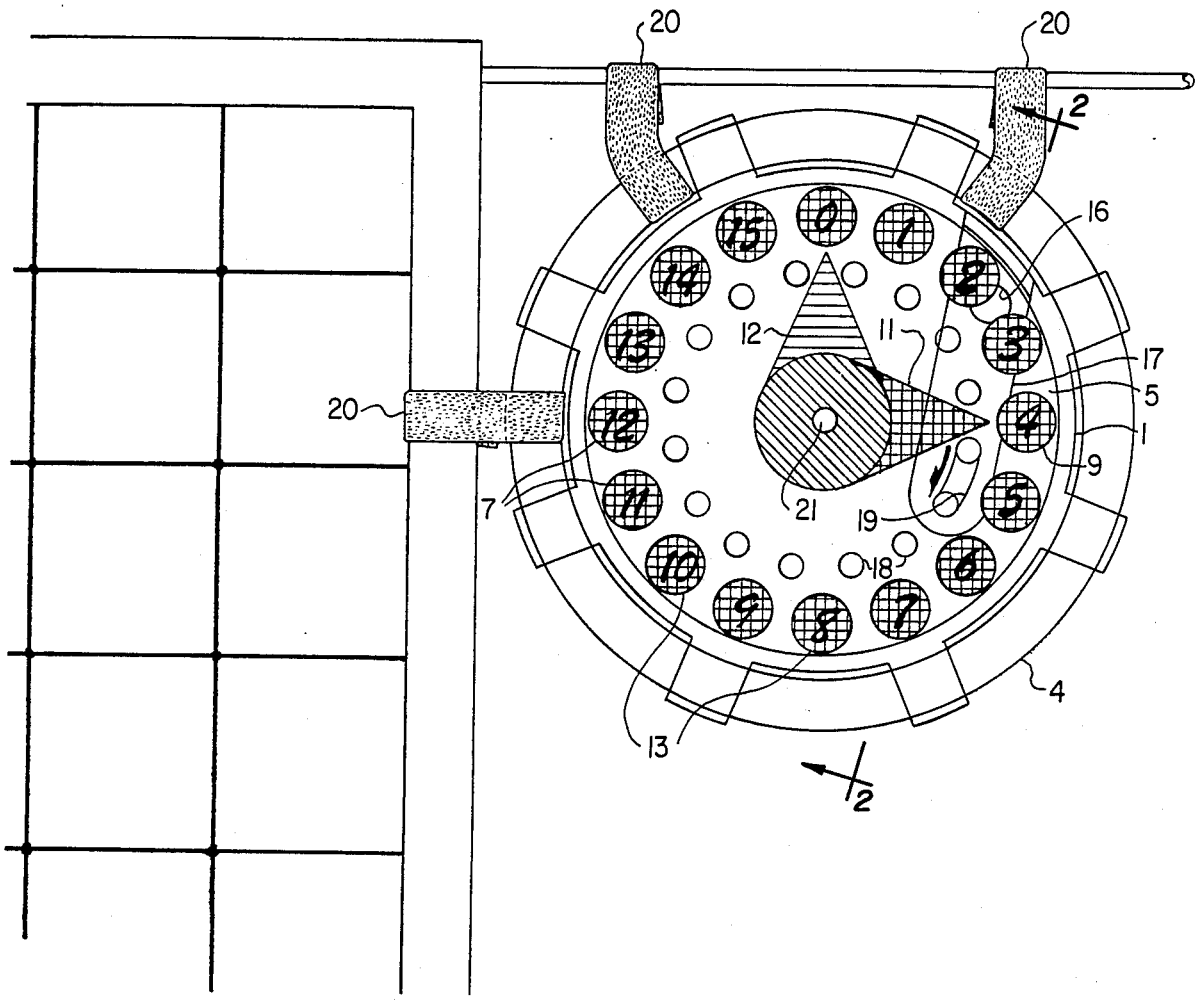
FIG. 1A is a front elevation view of the volleyball scoreboard of the present invention.

Referring to FIG. 1A, the scoreboard of the present invention is shown detachably mounted to a volleyball game net by three integral fabric mounting straps 20. When used to score a volleyball game, the invention is mounted on the game net as shown, and is located preferably just outside of the court side boundary so that it can be easily read at a glance by any of the volleyball players of either team at any time during a game. Mounting straps 20 are attached to frame hoop 4 and they are preferably made of a VELCRO material so that they may be easily fastened to the net and top rope.

In FIGS. 3A and 3B, it is shown that two series of score reference numbers 13 and 14 are located on the faces of the housing halves 1 and 2 respectively, one set for each of the two teams in a game. When the invention is mounted on the game net as in FIG. 1, one set of score reference numbers 13 and 14 faces each of the two opposing teams. Referring now to FIG. 3B there is shown on the face of each of the two score indicator disks 5 and 6 a translucent score indicator arrow 11 and 12, a translucent number background 9 and 10 immediately opposite the point of the indicator arrow 11 and 12, and a plurality of opaque number backgrounds 7 and 8 situated so as to encircle each of the score reference numbers 13 and 14 separately except the current game score numbers which are encircled with the translucent number backgrounds 9 and 10.

Figure 1B:
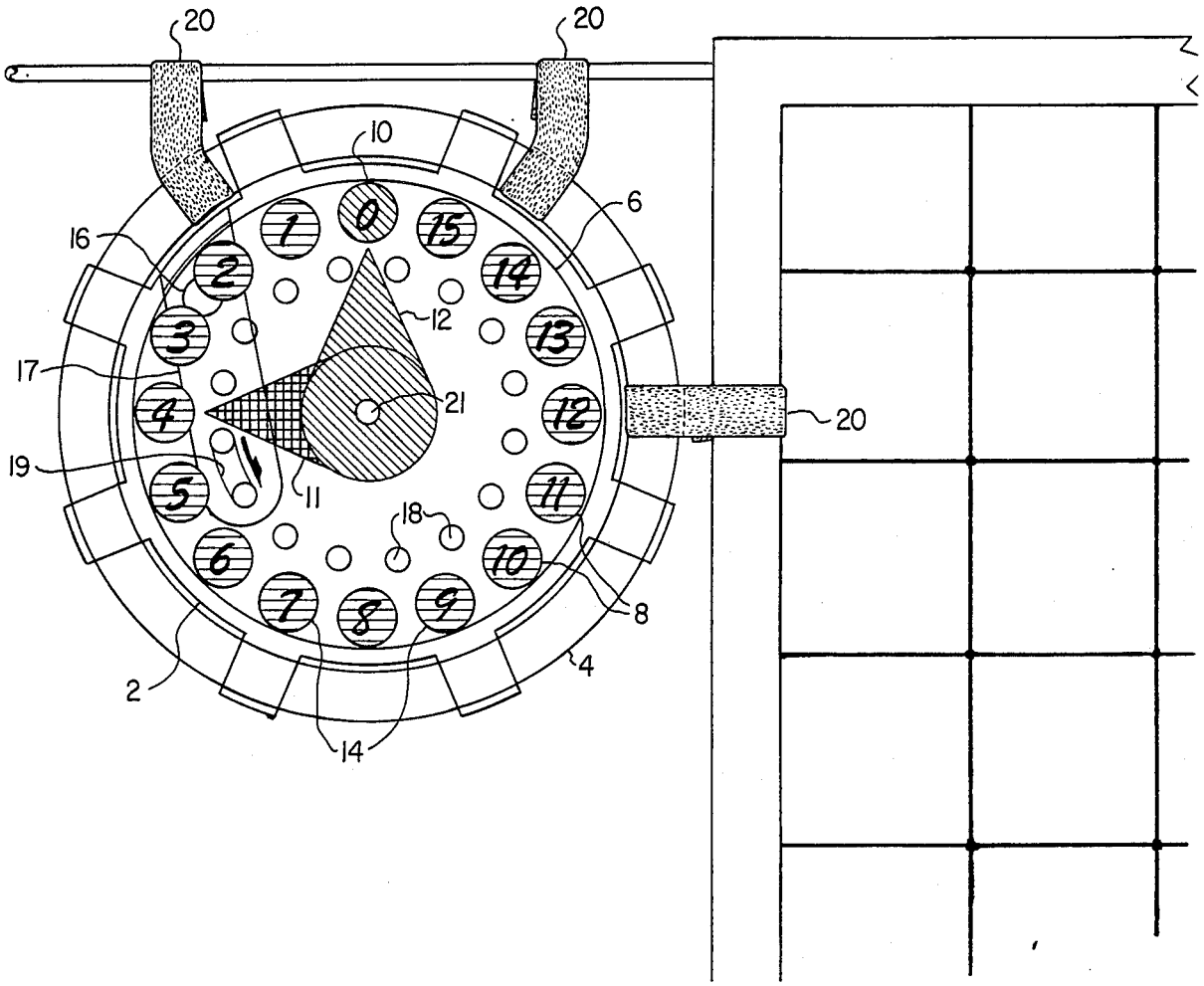
FIG. 1B; is a back elevation view of the volleyball scoreboard of the present invention.

Referring to FIG. 1A, it is shown here that this team's score reference numbers 13 progress in a clockwise fashion. This team's opaque number backgrounds 7, translucent number background 9, and translucent score indicator arrow 11, are all colored yellow. This team viewing the yellow side of the scorekeeper hereinafter will be called "home team". Home team's current game score, as indicated by their yellow score indicator arrow 11, is "4". The opposing team's score, as indicated by their blue score indicator arrow 12, visible through the transparent housing half 1, and transparent score indicator disks 5 and 6, is "0". FIG. 1B shows the scoreboard as viewed by the opposing team to the home team, hereinafter the "visiting team". The visiting team's score reference numbers 14 progress in a counterclockwise fashion so that both teams' score indicator disks 5 and 6 rotate in the same direction to advance the game score. The visiting team's opaque number backgrounds 8, translucent number background 10, and score indicator arrow 12, are blue. Thus, in FIG. 1B, the score is "0" for the visiting team as indicated by the blue score indicator arrow 12, and "4" for the home team as indicated by the yellow score indicator arrow 11.

When both teams have the same score, the score indicator arrows 11 and 12 are superimposed one over the other. The home team's score indicator arrow 11 is translucent yellow and the visiting team's score indicator arrow 12 is translucent blue. Thus, when the score is tied and the two translucent score indicator arrows 11 and 12 are superimposed one over the other, score indicators turn green from the combination of translucent blue and yellow. Also, when the team's scores are equal, the translucent number background 9 and 10 also are superimposed one over the other and become green in color. The side of a team's opaque number backgrounds 7 and 8 that face the opposing team are white in color so that the translucent number backgrounds 9 and 10 only turn green when the score is tied. When a player glances at the scoreboard and sees a green arrow pointing at a number with a green background he immediately knows the score is tied.

Figure 2:
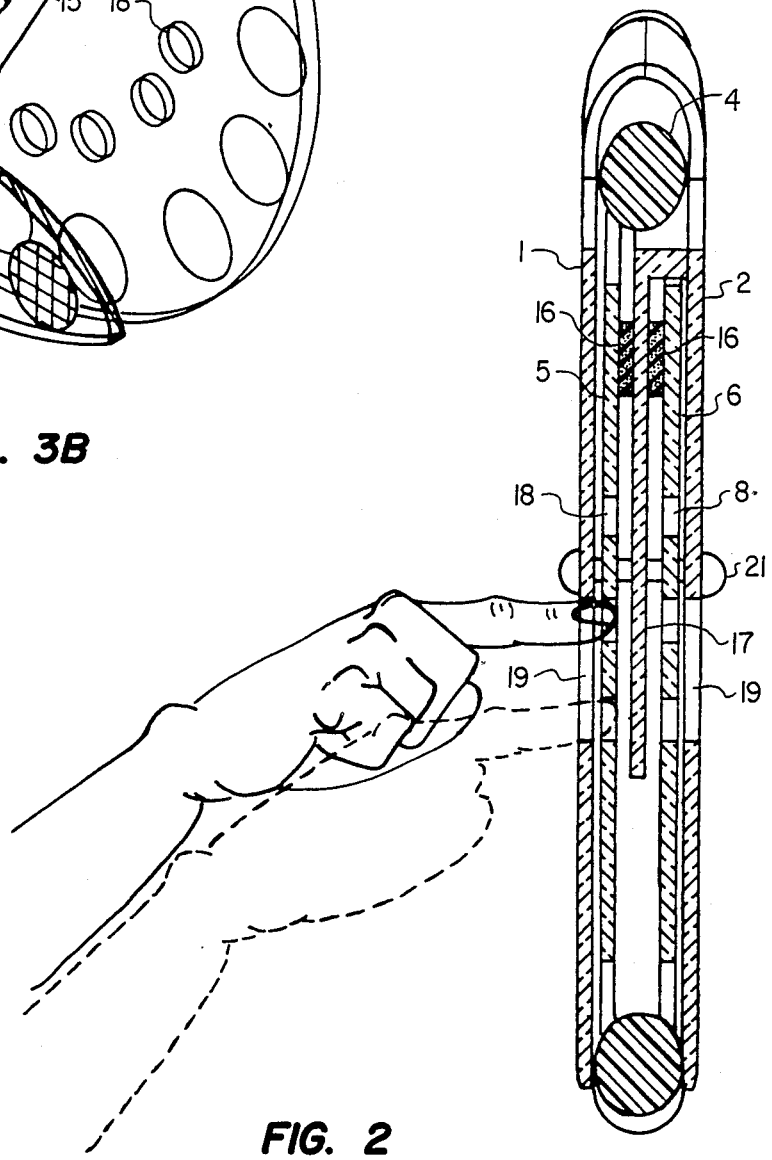
FIG. 2 is a sectional view taken along line 2—2 of FIG. 1A.

Each indicator disc has formed therein a plurality of finger holes 18 corresponding to the number of number backgrounds. A player advances his team's score by inserting his or her finger in the top of the access opening or score advance slot 19 in housing halves 1 and 2 and pushing down, similar to a dial telephone. The length of score advance slot 19 is equal to the distance between the outside edges of adjacent finger holes 19 in score indicator disks 5 and 6 so that a player can advance the score by only one number at a time. As illustrated clearly in FIG. 2, players can only advance their own team's score because when they put their finger in the top of the score advance slot 19 on their side they are putting their finger through a finger hole 18 in their team's score indicator disk 5 and 6 only, and are isolated from touching the opposing team's score indicator disk 5 and 6 by the barrier member 17. Also, rubber disk friction pads 16 are located on both sides of the barrier member 17 and rub against the score indicator disks 5 and 6 to maintain their set position that marks the score by resisting rotation.

From the foregoing it will be seen that this invention is one well adapted to attain all of the ends and objects hereinabove set forth together with other advantages which are inherent to the apparatus.

It will be understood that certain features and subcombinations are of utility and may be employed with reference to other features and subcombinations. This is contempted by and is within the scope of the claims.

As many possible embodiments may be made of the invention without departing from the scope thereof, it is to be understood that all matters herein set forth as shown in the accompanying drawings are to be interpreted as illustrative and not in a limiting sense.

What is claimed is:

1. A game scoring device, which comprises:

a housing having opposed substantially transparent faces, each of said faces having thereon a plurality of score indicia, and each of said faces having an access opening;

and a pair of indicator panels rotatably mounted in said housing between said faces, each of said indicator panels having thereon a score indicator, and each of said indicator panels having therein plurality of holes registerable with said access openings to permit said panels to be moved with respect to said housing.

2. The game scoring device as claimed in claim 1, including a barrier member sandwiched between said indicator panels and between said access openings of said housing.

3. The game scoring device as claimed in claim 2, including means for resisting movement of said indicator panels such that accidental movement of said panels is inhibited.

4. The game scoring device as claimed in claim 3, wherein said means for resisting movement includes drag members drsposed between said barrier member and said panels.

5. The game scoring device as claimed in claim 1, including means for affixing said housing to a volleyball net.

6. The game scoring device as claimed in claim 1, wherein each of said score indicators is of a different color.

7. The game scoring device so claimed in claim 6 wherein each of said score indicators is translucent.

8. The game scoring device as claimed in claim 1, wherein each of said indicator panels has thereon a plurality score indicia background markers.

9. The game scoring device as claimed in claim 8, wherein one of said score indicia backround markers is translucent.

10. The game scoring device as claimed in claim 8, wherein at least some of said score indicia backround markers are opaque.

11. The game scoring device as claimed in claim 1, wherein said housing is substantially circular.

12. The game scoring device as claimed in claim 11, wherein said indicator panels are defined by disks rotatably mounted in said housing.

13. The game scoring device as claimed in claim 12, wherein said score indicia are defined by a plurality of radially spaced apart numerals arranged in a circle about the center of said faces of said housing.

14. The game scoring device as claimed in 13, wherein said holes in said rotatably mounted disks are positioned in a circle about the center of said rotatably mounted disks.

15. The game scoring device as claimed in claim 14, wherein each of said holes has a radially outside edge and said access opening is defined by a slot having a length equal to the access opening is defined by a slot having a length equal to the distance between the radially outside edges of adjacent holes in said rotatably mounted disks.

* * * * *